US005361854A

United States Patent [19]

Tull et al.

[11] Patent Number: 5,361,854

[45] Date of Patent: Nov. 8, 1994

[54] LASER POSITIONING SYSTEM FOR EARTH BORING APPARATUS

[75] Inventors: Herbert Tull, Ruston; Frederick Berry, West Monroe, both of La.

[73] Assignee: Lag Steering Systems, Rocky Mountain, N.C.

[21] Appl. No.: 131,756

[22] Filed: Oct. 5, 1993

[51] Int. Cl.[5] ..... E21B 47/00

[52] U.S. Cl. ..... 175/45; 175/61

[58] Field of Search ..... 175/40, 45, 61, 62, 175/73

[56] References Cited

U.S. PATENT DOCUMENTS

| | | | |
|---|---|---|---|
| 4,013,134 | 3/1977 | Richmond et al. | 175/73 |
| 4,042,046 | 8/1977 | Capoccia | 175/73 |
| 4,438,820 | 3/1984 | Gibson | 175/45 |
| 4,506,745 | 3/1985 | Bjor | 175/45 |
| 4,656,743 | 4/1987 | Thiemann et al. | 31/1 H |
| 5,099,927 | 3/1992 | Gibson et al. | 175/45 |
| 5,133,418 | 7/1992 | Gibson et al. | 175/45 |
| 5,203,418 | 4/1993 | Gibson et al. | 175/45 |

*Primary Examiner*—Thuy M. Bui
*Attorney, Agent, or Firm*—Cort Flint

[57] ABSTRACT

A laser positioning and measuring system for an earth boring apparatus is disclosed which includes a unique measuring unit comprising a pair of lasers mounted in a back-to-back relation with targets at their free ends. The targets include a beam passage through which laser beams from the measuring units are emitted. The emitted laser beams strike a target on an adjacent measuring unit. The area of which the laser beam impinges upon the adjacent targets generates a signal to indicate the displacement of the laser beams with respect to the adjacent targets to provide a coordinate and angle signals. The signals are processed in the computer to indicate deviations between the measuring units. The measuring units are spaced along the bore, for example, by attachment near the joints of the individual pipe casings which are pushed through the bore by the earth boring apparatus. The deflection of the casings from the desired bore direction is measured by the measuring units as disposed at the joints of the casing and processed to indicate a deviation in the distance of the leading pipe casing from the point of origin. Each target comprises a photo array of light sensing elements which detects the impingement area of the beam coming from the adjacent measuring unit.

33 Claims, 5 Drawing Sheets

LASER POSITIONING SYSTEM FOR EARTH BORING APPARATUS

BACKGROUND OF THE INVENTION

This invention relates to an apparatus for boring or tunneling underground using an earth boring, drilling, or tunneling machine. In particular, the invention relates to a laser positioning system for measuring the position pipe casing or bore forming machinery as it is as it is pushed and steered through the earth so that a more accurate line and grade of the bore or tunnel may be had.

Prior earth boring machines are known which are slidably mounted and reciprocated longitudinally along a track by means of a hydraulic piston assembly. The forward end of the boring machine rotatably mounts an auger which is rotated within the interior of the pipe casings with the forward end of the auger boring a hole in the earth. The auger bores the hole and carries the dirt outwardly for ejection at the boring machine. The hydraulic pistons are forced on the boring machine to drive the pipe casings through the bore as it is formed. Successive pipe casings are attached to the string of pipe casings as the bore progresses. A steering head is typically located at the forward pipe casing and is provided with a directional control device. Typical earth boring machines are disclosed in U.S. Pat. Nos. 4,042,046; 4,013,134; and 4,438,820. U.S. Pat. No. 4,042,046 discloses an earth boring machine having a double jointed steering head so that its direction may be controlled in both the vertical and horizontal planes. The system does not have an entirely reliable means for measuring the position of the cutting head in both the horizontal and vertical planes so that it may be steered accurately. U.S. Pat. Nos. 4,042,046 and 4,013,134 utilize a conventional water level to determine the grade of the casing. That type of device includes a sight tube on an indicator board at the boring pit station connected to a water line affixed to the top of the casing being bored and pushed through the ground. Any deviation in the leading edge of the casing from the desired grade either up or down provides a corresponding response to the water level in the sight tube at the boring pit. Based on the readings of the sight tube, the operator in the boring pit may pivot the steering head of the casing in the vertical plane by means of a mechanical linkage. However, the water line connected to the sight must be vented on both ends. If the device is used below the water table, water can enter the tube and interfere with the reading of the sight tube. The water level devices also have inherent vibration problems which necessitate that the apparatus be shut down to take a reading of the sight tube. The sight tube cannot be monitored simultaneously with the boring operation. With the vibrations, air locks are often created which interfere with the accuracy of the reading in the sight tube. The above inaccuracies can result in the final line being off grade which often requires re-boring. U.S. Pat. No. 4,438,820 proposes an improved rate sensor for eliminating the problems utilized in water level sensors. However, the problem remains that the prior art earth boring and tunneling machines do not recognize the ability to provide means for accurately measuring the position of the steering or cutting head.

U.S. Pat. No. 5,133,418, discloses a directional drilling system with an eccentric mounted motor and biaxial position sensor for steering a drilling string forming a bore underground. This system has been found advantageous for many applications, particularly where a rotating drill string is used. The position and measuring system relies heavily on electronics including an angular rate sensor and encoder which operate with an eccentric mounted drilling head to not only measure the position of the drill string, but also the rotational position of the eccentrically mounted drilling head.

U.S. Pat. No. 5,099,927 discloses an apparatus for guiding and steering an earth boring casing. This application also utilizes a positioning measuring system that includes a pair of angular rate sensors whose sensing axes are rotated 90 degrees with respect to each other, and also relies heavily on electronics.

U.S. Pat. No. 4,656,743 discloses an arrangement for determining the position of a hollow section system which is pushed forward which comprises measuring apparatus arranged one behind the other in the hollow section system. However, the light sources and detectors are located in the apparatus such that optical systems must be employed for beam direction. This renders the apparatus high susceptible to misalignment when used in this rather harsh environment of underground boring or pipe pushing.

Accordingly, an object of the invention is to provide a highly accurate and reliable positioning measuring system for guiding an earth boring apparatus Another object of the present invention is to provide an improved position measuring system for an earth boring apparatus utilized to form underground bores such as tunneling machines, pipe pushing machines, direction drilling machines, and the like.

Another object of the present invention is to provide an improved measuring system for guiding and steering an earth boring apparatus which minimizes the amount of electronics that are used.

Another object of the invention is to provide a highly accurate and reliable laser positioning measuring system for measuring the position and guiding an earth boring apparatus while being steered to form an underground bore.

SUMMARY OF THE INVENTION

The above objectives are accomplished according to the present invention by providing a laser position measuring unit for use with an earth boring apparatus of the type which includes a cutting head for cutting an underground bore through the earth, and steering system for steering the cutting head through the earth to form a bore in a prescribed direction. The measuring unit includes a first beam transmitted in a first direction and a second beam directed in a second, reversed direction. A pair of targets are carried at opposing ends of the measuring unit which includes a first target disposed on one end and a second target disposed on an opposing end. A plurality of the measuring units are disposed in series relation to the boring apparatus. The first beam of a measuring unit impinges upon a second target of an adjacent measuring unit. The second beam of the measuring unit impinges upon the first target of an adjacent measuring unit in the second direction. The targets include a detector for providing position signals in response to an area of the target upon which the beams impinge. A processor receives the position signals for determining the position of the cutting relative to a home platform so that the cutting head may be steered to cut the bore along a desired underground path.

The earth boring apparatus may be a pipe pusher machine, tunneling machine, directional drilling machine and the like. When used with a pipe pushing machine, the casing string is pushed through the earth and steered as the casing is pushed through the earth to form a bore in a prescribed direction. The earth boring apparatus typically comprises an operating platform disposed at a starting point. A plurality of individual pipe casings are joined together to form a casing string. A plurality of casing joints are defined between adjacent pipe casings. A plurality of measuring units are carried by the casings at pre-determined locations along the casing string including at least a first, second, and third measuring unit carried successively on adjacent first, second, and third casings, respectively. The measuring units include first beams transmitted in the first direction and second beams directed in the second, reverse direction. The first beam of the second measuring unit impinges upon a second target of the third measuring unit. The second beam of the second measuring unit impinges upon a first target of the first measuring unit. The second target of the measuring unit includes a detector for providing a coordinate signal in response to the impingement of the first beam upon the detector representing a position defined by at least two coordinates. The first target of the first measuring unit includes a detector for providing an angle signal responsive to the impingement of the second beam upon the detector representing an angular relationship between the first and second measuring units. A computer receives the coordinate and angular signals for determining the position of the cutting head of the casing string relative to the platform. A home measuring unit is disposed at the drilling platform which includes a first beam, and a front target. An end measuring unit is carried by the leading pipe casing of the string which includes only a target.

Preferably, the detector of the targets include a photo array of light sensing elements for detecting the area on the target upon which the first and second beams impinge. The processing circuit for processing the signals from the light sensing elements for generating the coordinate and angle signals for transmission to the computer for processing. The first beam is transmitted in a forward direction, and the second beam is directed in a rearward direction. The first target is disposed on a front end of the measuring units and the second target is disposed on a back end of the measuring units. The first and second beams coincide and lie in a first plane, and the targets comprise an array of light sensing elements disposed in a second plane orthogonal to the first plane of the first and second beams. The measuring units include a first laser and a second laser mounted in a back-to-back relation. An adjustable mount provides adjustment of the position of the lasers so that the first and second beams and lie in the first plane. The first and second targets of the measuring units are disposed near the ends of the first and second lasers. A light delivery passage is formed in the center of the array of light sensing elements which allows delivery of the first and second beams through the first and second targets.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
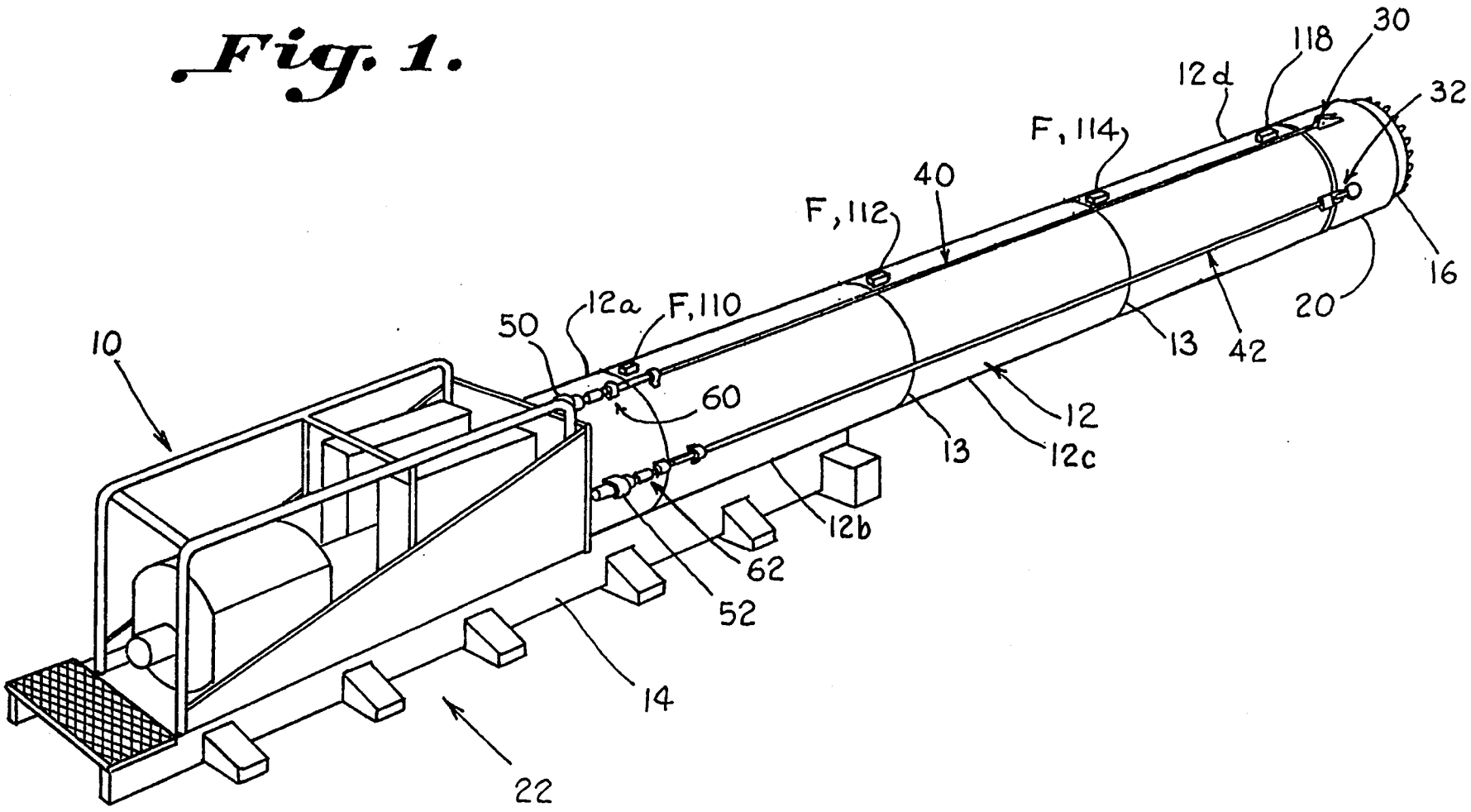
FIG. 1 is a perspective view of one embodiment of an earth boring apparatus for forming a bore underground which incorporates a measuring system according to the invention.

Referring now in more detail to the drawings, an earth boring apparatus is designated generally as 10. For purposes of illustrating the invention, a pipe pushing apparatus is illustrated which may be any suitable machine such as a Model 36-600, horizontal earth boring machine manufactured by American Augers of Wooster, Ohio, as can be seen in FIG. 1. Such earth boring machines are well known, and only those portions of a machine necessary to an understanding of the invention will be illustrated. The earth boring machine is driven by a hydraulic motor which actuates a push bar or piston (not shown) to force steel pipe casings, generally designated as 12, along a track 14 as they enter the earth and are forced through a bore which is cut up by a cutting head 16. As the cased bore is formed, the hydraulic pusher is retracted and a new casing 12 is connected to a rear casing **12*a* and then the new casing is pushed forward. There are four such casings shown in FIGS. 1, 12*a*, 12*b*, 12*c* and 12*d*. This continues until the cased bore is completed. At the forward end of the string of casings, there is forward casing 12*d* pivotally connected to a steering head, designated generally as 20. Cutting head 16 is carried by steering head 20 in a conventional manner and an auger (not shown) inside the interior of the casings 12 carries the cut materials through the casings to be injected by the boring machine 10 at the boring pit or platform station 22**.

A hinge connects steering head 20 and forward casing **12*d* for rotation of the steering head about first and second orthogonal axes X, Y. There is a first hinge having two-degrees of freedom about the X, Y axes and a second hinge having two-degrees of freedom about those axes. Preferably, each hinge includes a hinge assembly which includes a bearing mount 4, and an annular bearing 6 which surrounds an annular hub 8** of the bearing mount. For more details of the steering and hinge apparatus, reference may be used to U.S. Pat. No. 5,099,927, incorporated by reference.

Actuators are connected to steering head 20 for imparting an actuation force which rotates the steering head through first and second hinges 30, 32 about first and second axes. The actuator includes a first actuator, designated generally as 40 and a second actuator designated generally as 42. Preferably, each actuator includes a drive motor 50 having a drive shaft (not shown) connected to a gear or reduction box which reduces the rpm of the drive shaft. Motors 50, 52 may be any suitable control motors such as an electric or hydraulic motor driven in incremental motions to impart precise rotational control movements which is translated into reciprocating linear motion by mechanisms 60, 62. The reciprocating linear motion of the actuators will cause steering head 20 to be raised or lowered about horizontal axis A in a pitch motion to change the grade, or cause steering head 20 to pivot about the Y axis to steer steering head 20 left or right in a yaw motion. Again, for more detail, reference may be had to the above incorporated patent disclosure.

The measuring unit of the above referenced invention will now be described with reference to earth boring apparatus of the type using a pipe pusher head machine. It being understood that the invention may also be used with other earth boring apparatus such as a tunneling machine, a directional drilling machine with a mud motor, microtunneling machine, and the like.

As can best be seen in FIGS. 2–5, a position measuring system for measuring the position of front casing **12*b* in terms of X, Y, and Z coordinates is illustrated. The position measuring system includes a laser measuring unit designated F that is carried by each pipe casing 12. A position measuring unit F is located near a joint 13** on each pipe casing. It is to understood, of course, that pipe casings are added to the string at the pit, each newly added pipe casing will include a measuring unit F that is tied into the remaining measuring units.

Figure 4:
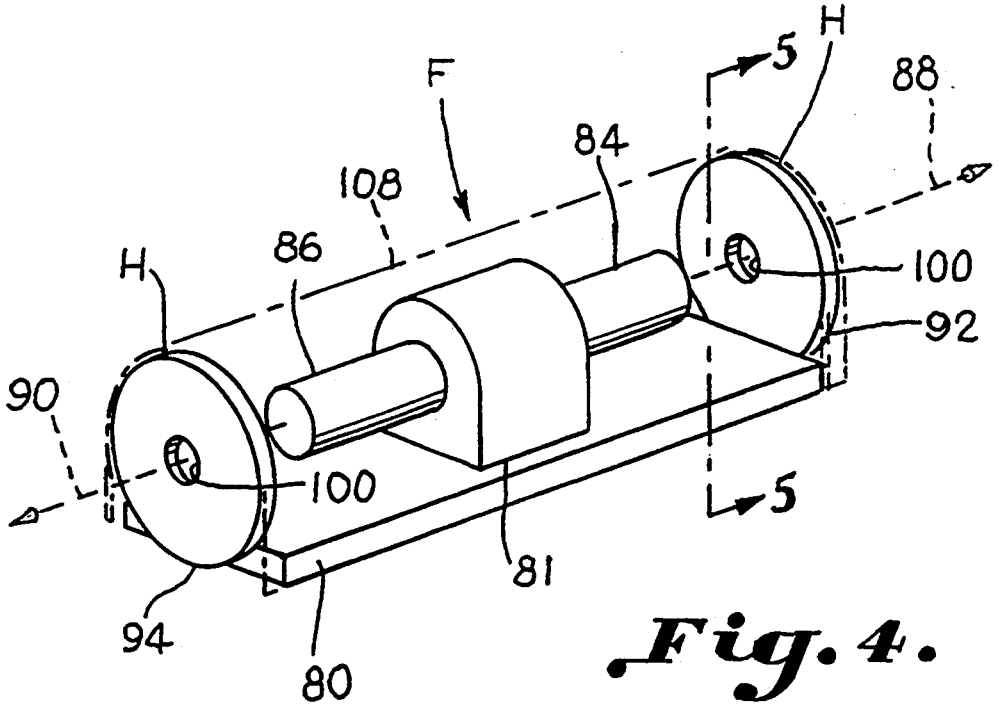
FIG. 4 is a perspective view of a positioned measuring unit constructed according to the present invention.
Figure 5:
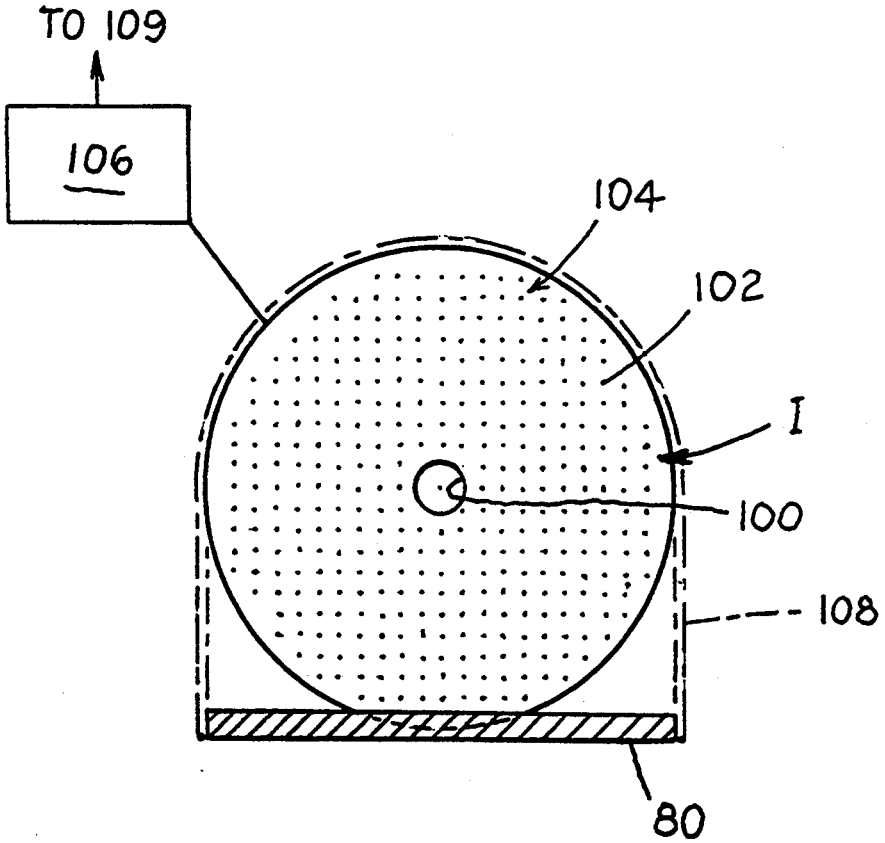
FIG. 5 is an elevation of a photo array having an array of light sensing elements constructed according to the invention.
Figure 7:
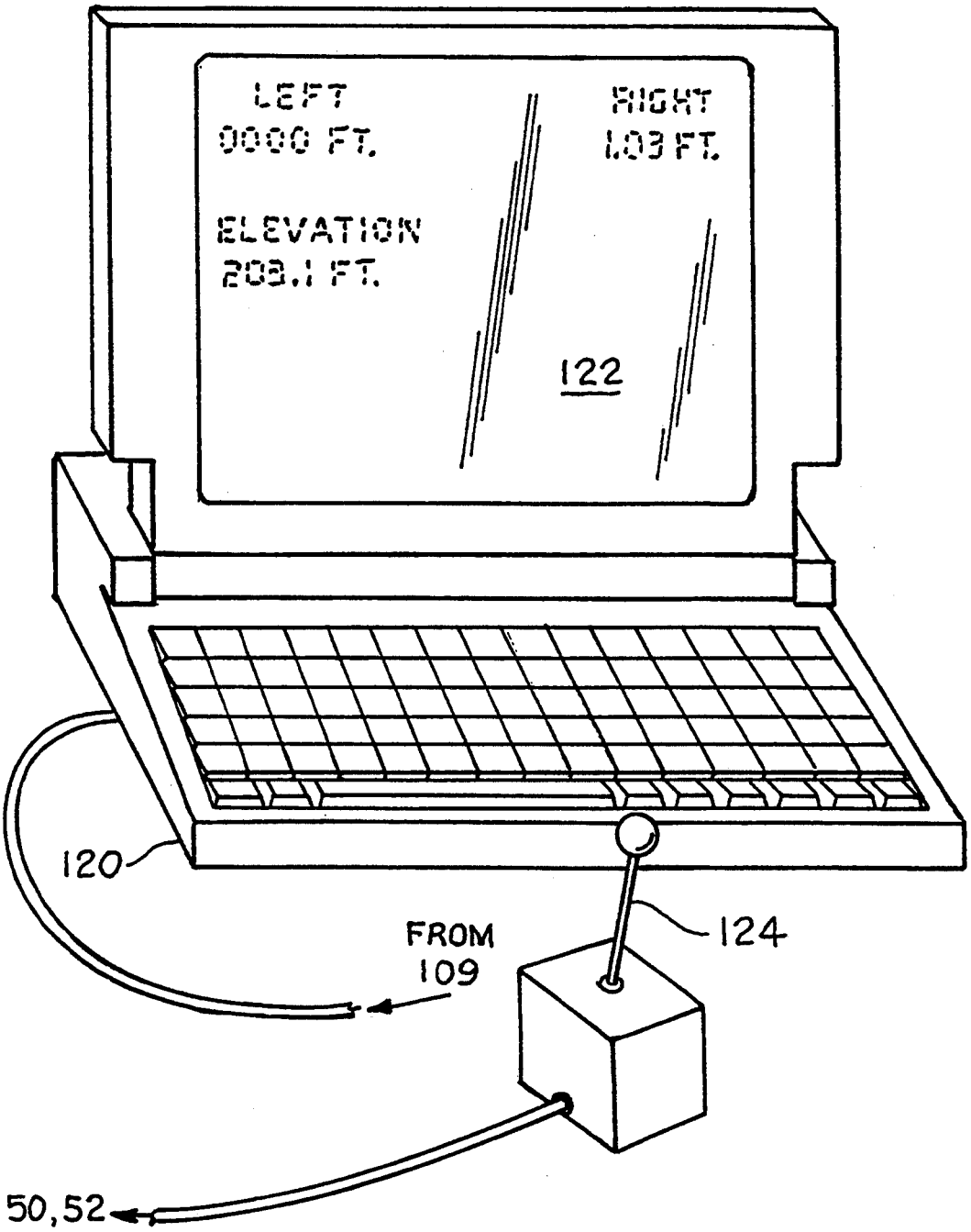
FIG. 7 is a perspective view illustrating a computer and display for calculating and displaying deviations from a desired bore path.

Referring now to FIGS. 4 and 5, an embodiment of a laser measuring unit according to the invention will now be described. There is a base 80 affixed to a casing 12, and a mount 81 carried on the base for mounting a pair of laser units in a back-to-back manner. There is a first laser unit 84 which emits a first beam 88 in a first, forward direction. Laser 86 emits a beam 90 in a second, reversed direction. Lasers 84, 86 may be any suitable laser units such as laser model LDM 145-670-3mw manufactured by Edmond Scientific of Barrington, N.J. The lasers preferably include laser diodes **84*a*, 86*a* mounted in housings 85 having a clearance 85*a* which allows the laser diodes to be adjustably mounted to align beams 88, 90 in a common plane. The adjustable mount is further provided by set screws 87 which fix the diodes in the bore of the housing standard 9-volt batteries 89** may be used to power the laser diodes.

Measuring unit F further includes a pair of targets H which include a front target 92 and a rear target 94 carried at opposing ends of the measuring units. Target 92 includes an annular beam passage 100 through which first laser beam 88 passes. Second target 94 includes a similar annular passage 100 for the transmission of laser beam 90. As illustrated, first target 92 is on the front of the measuring unit and second target 94 is on the back of the unit. Each target 92, 94 includes a photo array, designated generally as I which includes a plurality of light sensing elements 102 arranged in a grid array designated generally as 104, as can best be seen in FIG. 5. The light sensing elements 102 may be any suitable phototransistor (light sensing transistors or diodes), such as model LS600 manufactured by Texas Instruments. In one embodiment, a two and one-half inch target was utilized with four hundred and forty-four phototransistors arranged in a rectangular grid pattern, as shown in FIG. 5. A housing 108 is provided for the measuring unit. In addition, a secondary printed circuit board, illustrated schematically as 106, is mounted directly behind the target bores to provide a processing circuit which performs most of the switching, gating, and buffering functions. For example, a suitable circuit may be a conventional binary synchronized counter which collects the signals from the illuminated phototransistors and combines the signals together to produce an output signal 107 representative of the area upon which the beam has impinged, and hence the position of the beam. Alternately, a suitable microprocessor may be utilized to process the phototransistor signals. The signals 107 are serially transmitted to a data acquisition processor or system 109.

Figure 2:
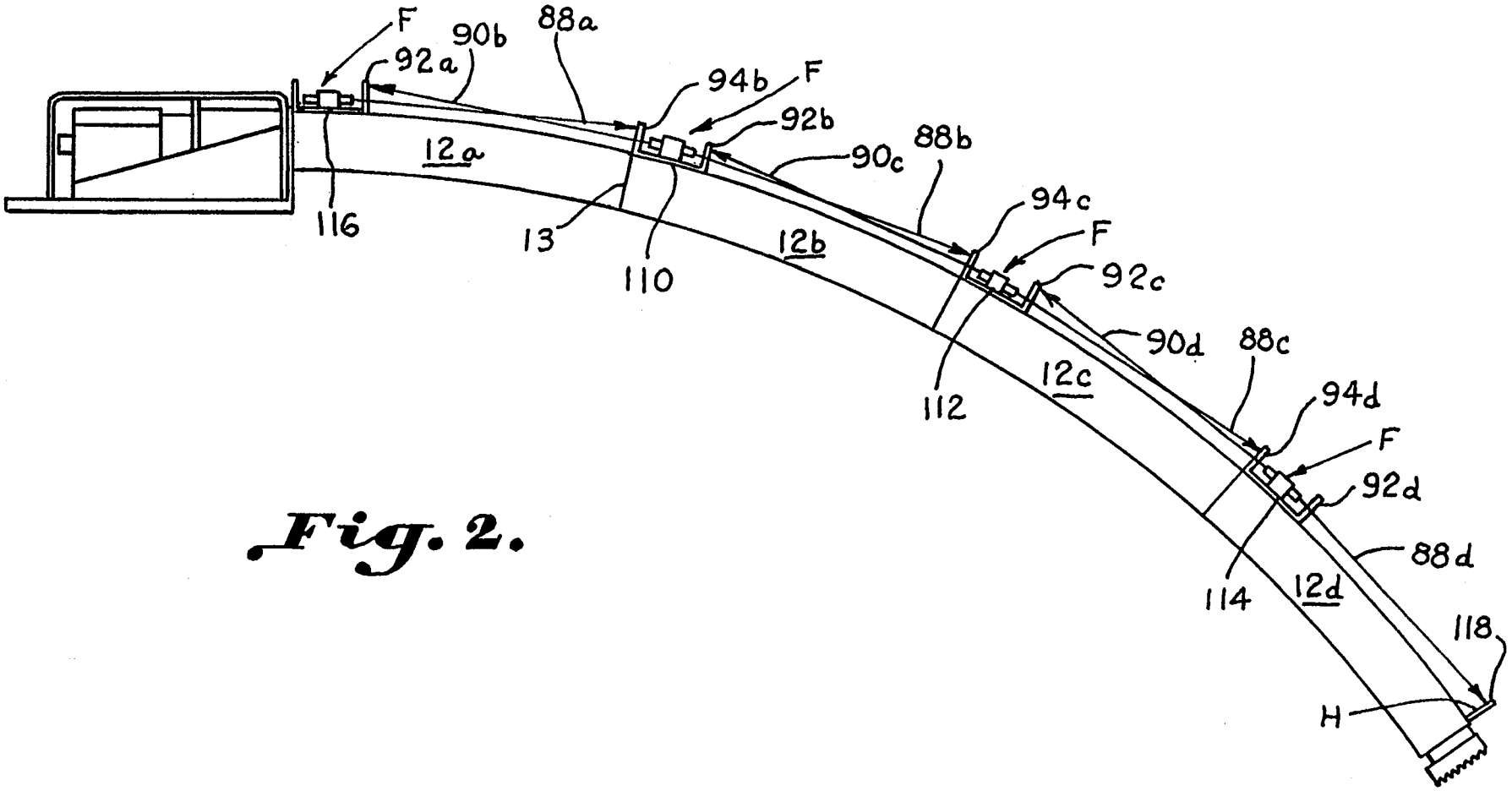
FIG. 2 is a schematic illustration of a string of pipe casings joined together which are pushed and steered underground to form a bore using a laser positioning system according to the invention.
Figure 6:
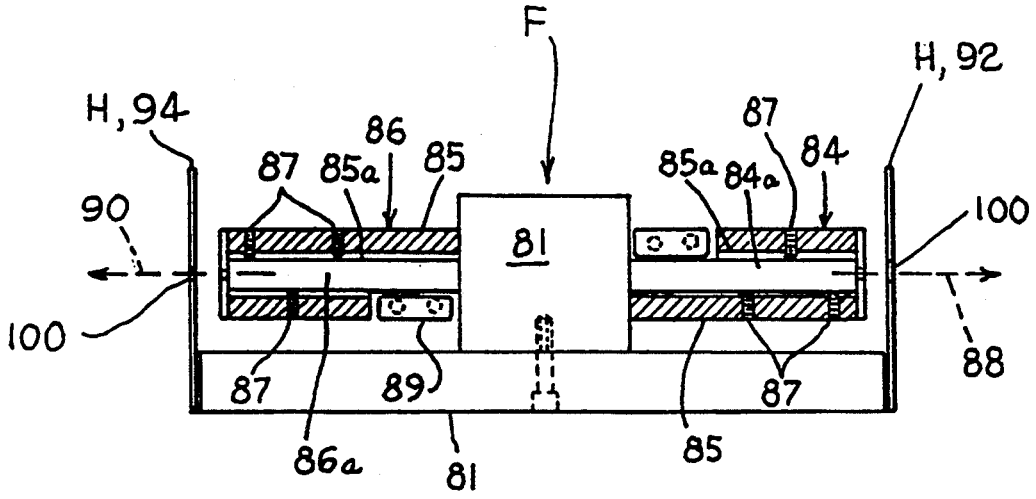
FIG. 6 is a sectional view of a measuring unit constructed according to the invention.

Referring now to FIG. 2, an embodiment of the invention will be illustrated with four casings, **12*a*, 12*b*, 12*c*, 12*d*. Pipe casing 12*d* is the leading pipe casing and includes only a target H near its free end. While actually the pipe casings will be approximately twenty feet in length and the measuring units F will be quite small (i.e., 2 inches) in comparison. It is to be understood, of course, that the proportions illustrated in FIG. 2 are for illustrative purposes only. There are four measuring units F disposed near the joints 13 of the pipe casings. For purposes of illustration, a first measuring unit 110, a second measuring unit 112, and a third measuring unit 114 will be referred to. A home measuring unit 116 at the point of origin, (i.e., the drilling platform or pit) is referred to as the home measuring unit and includes only a first beam 88*a* and a front target 92*a*** connected to the measuring and guidance system. The second beam and rear target will not be functional when a measuring unit F is in the position of a home measuring unit.

First measuring unit 110 of casing **12*b* includes a first beam 88*b* in the forward direction, and a second beam 90*b* in the reversed direction. There will be a front target 92*b* and a back target 94*b*. Second measuring unit 112 of casing 12*c* has a first beam 88*c*, and a second, reversed beam 90*c*. Second measuring unit 112 has a front target 92*c* and a back target 94*c*. Similarly, third measuring unit 114, carried on casing 12*d*, will have a first beam 88*d*, and a reversed, second beam 90*d*. The measuring unit will have a front target 92*d* and a back target 94*d***.

Figure 3:
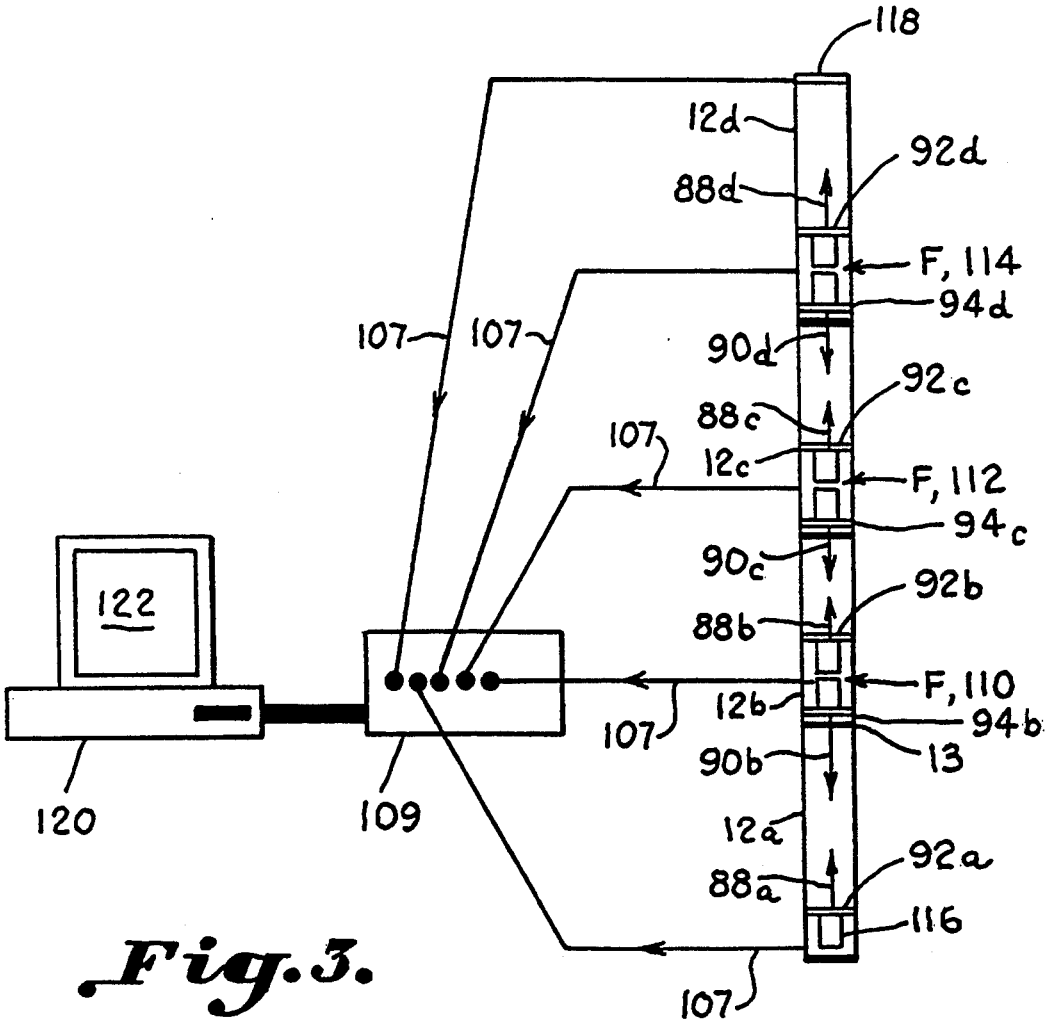
FIG. 3 is a schematic view illustrating a laser positioning system according to the invention for guiding a string of pipe casings underground to form a bore.

In operation, referring to FIGS. 2 and 3, the measuring units collectively measure the position of end target 118 with respect to home target 116. That is, the target at the leading end of leading casing **12*d* with respect to the home measuring unit at drilling platform 22 in terms of X, Y, Z coordinates. Laser beam 88*a* impinges upon target 94*b* and provides an X, Y position of measuring unit 110 with respect to home measuring unit 116. Laser beam 88*b* from measuring unit 110 impinges on target 94*c* of measuring unit 112 and provides an X, Y position of measuring unit 112 with respect to measuring unit 110. Laser beam 88*c* from measuring unit 112 impinges upon target 94*d* and provides an X, Y position of measuring unit 114 with respect to measuring unit 112. Laser beam 88*d* from measuring unit 114 impinges upon end target 118 and provides an X, Y position of target 118 with respect to measuring unit 114**.

Referring now to the second, reversed laser beam from each measuring unit, laser beam **90*b* from measuring unit 110 impinges upon target 92*a* of home measuring unit 116 and provides the angle of measuring unit 110** with respect to home measuring unit. Laser beam 90*c* from measuring unit 112 impinges upon front target **92*b* of measuring unit 110 and provides the angle of measuring unit 112 with respect to measuring unit 110. Laser beam 90*d* from measuring unit 114 impinges upon target 92*c* of measuring unit 112 and provides the angle between measuring unit 114 and measuring unit 112. There is no angular measurement between end target 118 and measuring unit 112 since they are both on the same pipe casing. The coordinate and angle information from the measuring units is then fed to a computer 120 which calculates the X, Y, Z position of target 118 with respect to home measuring unit 116, and may be used to display deviations on a display 122. Distance is determined at the point of origin, i.e. drill platform, by knowing the total length of casings that have been pushed through the bore. Previous to being received from the computer, the coordinate and angle signals may be processed in a data acquisition system 109 such as a conventional data controller card manufactured by National Instruments, Inc. The computer may display coordinates and deviations, and the cutting head may be steered accordingly to maintain the desired path using a joystick controller 124. Alternately, a feed back from the computer may be had to control motors 50, 52** for steering the cutting head, and the controls and steering may be controlled automatically.

Thus, it can be seen that an advantageous construction can be had for a positioning system for guiding earth boring apparatus according to the invention wherein a series of measuring units are mounted on the steel pipe casings being installed, or on a tunneling machine when only a bore is being formed, Each measuring unit includes two lasers, back-to-back, with a target at each end. The target is an accu-target with an array of pixels which sense the location of the laser spot. In practice, the units are spaced at twenty feet spacings, or any other suitable spacings, depending on the installation, and each unit measures the displacement of that signal. The information is collected from all the measuring units and fed to a computer which calculates the total deviation from the design path, both horizontally and vertically. This information may be displayed both graphically and numerically on the computer screen. Based on this information, the operator makes adjustments to bring the pipe back on grade in line. An error analysis of the design system indicates that the maximum error over each measuring unit will be approximately 0.0375 inches. For a one hundred foot bore, using twenty foot pipe casings, the theoretical maximum possible error is between 9/16 inches and ¾ inches.

In the illustrated earth boring apparatus, the front end of the pipe casing consists of an articulated cutting head. The head can be adjusted to make the pipe go up, down, left, or right. The precise location of the pipe is determined by the measuring units. Adjustments are made on the head by using a screw mechanism attached to the top side of the pipe. The screw mechanism is operated from the jacking pit or platform through a series of rods which are rotated to make necessary adjustments, as disclosed in U.S. Pat. No. 5,099,927. The control process can be simplified so that the operator makes adjustments using joy stick 124 which controls electric powered motors instead of manually turning the steering rods.

When used with a mini-directional drilling system, the pipe to be installed is not rotated. An slanted nose piece is used to steer the pipe in any direction as shown in U.S. Pat. No. 5,163,520, incorporated by reference. The slant in the nose creates a bias in a particular direction. The nose can be rotated to make the pipe go in any particular direction. The nose section is telescopic and can be hydraulically withdrawn in its sleeve when a biasing effect is not required. In this case, the measuring unit may be mounted inside the pipe just behind the nose piece. Again, a lap top computer in the jacking pit displays the horizontal and vertical deviations from the design path. The horizontal and vertical angle of the front end of the pipe, the position of the slanted nose piece, and if the slanted nose piece is extended or retracted. The operator then makes adjustments to the nose piece using a joy stick based on the information from the guidance system.

Once the installation is complete, the computer may be used to draw an "as installed" profile of the pipe casing and the data on the installation may be saved on a floppy disk and serve as a permanent record of installation. This information may be very useful for owners, agencies, designers, constructors, contractors, etc. for planning future jobs.

When automated, the computer may be used to sense the deviations, and generate the commands to make necessary corrections which are fed directly to the control of the steering system. The operator only is required to push the pipe and let the computer control the steering. Very accurate installation is expected when automated, and the line and grade can be monitored through every inch of the installation, compared to manual steering where it is usually done every four to six feet. In the present system, it is expected that position calculations can be carried out every one to fifteen seconds.

The position measuring system is independent of the method of installation, and length and depth of the bore. It is non-magnetic, and it is hence not effected by magnetic fields developed by the movement of heavy equipment or the existence of nearby structures or utilities, which is a major problem associated with existing guidance systems. Using the present invention, it is possible to accomplish crossings under rivers, ponds, major highways, etc., without any obstruction to the movement of traffic or environmental effects.

While a preferred embodiment of the invention has been described using specific terms, such description is for illustrative purposes only, and it is to be understood that changes and variations may be made without departing from the spirit or scope of the following claims.

What is claimed is:

1. Earth boring apparatus which includes pipe casing, and means for pushing the casing through the earth and steering the casing as the casing is pushed through the earth to form a bore in a prescribed direction, said apparatus comprising:

an operating platform disposed at a starting point;

a plurality of individual pipe casings joined together to form a casing string;

a plurality of casing joints defined between adjacent pipe casings;

a plurality of measuring units carried by said casings at pre-determined locations along said casing string including at least a first, second, and third measuring unit carried successively on adjacent first, second, and third casings, respectively;

said measuring units including a first beam transmitted in a first direction and a second beam directed in a second, reverse direction;

a pair of targets carried at opposing ends of said measuring units including a first target disposed on one end and a second target disposed on an opposing end;

said first beam of said second measuring unit impinging upon a second target of said third measuring unit;

said second beam of said second measuring unit impinging upon a first target of said first measuring unit;

said second target of said third measuring unit including a detector for providing first and second signals in response to the impingement of said first beam upon said detector representing a positional relationship between said second and third measuring units; and said first target of said first measuring unit including a detector for providing a third signal responsive to the impingement of said second beam upon said detector representing a positional relationship between said first and second measuring units.

2. The apparatus of claim 1 including a home measuring unit disposed at said drilling platform which includes a first beam, and a front target.

3. The apparatus of claim 2 including an end measuring unit carried by the leading pipe casing of said drill string which includes only a target.

4. The apparatus of claim 1 wherein said detector of said first and second targets include a photo array of light sensing elements for detecting an area on said target upon which said first and second beams impinge.

5. The apparatus of claim 1 wherein said first and second signals correspond to coordinate signals and said third signal corresponds to an angle signal, and including a computer for receiving said coordinate and angle signals for determining the position of said casing relative to said platform.

6. The apparatus of claim 5 including a processing circuit for processing signals from said light sensing elements and generating said coordinate and angle signals for transmission to a computer for processing.

7. The apparatus of claim 1 wherein said first beam is transmitted in a forward direction, and said second beam is directed in a rearward direction; and wherein said first target is disposed on a front end of said measuring units and said second target is disposed on a back end of said measuring units.

8. The apparatus of claim 1 wherein said first and second beams coincide and lie in a first plane, and said targets comprise an array of light sensing elements disposed in a second plane orthogonal to said first plane of said first and second beams.

9. The apparatus of claim 8 wherein said measuring units include a first laser and a second laser mounted in a back-to-back relation; and means for adjusting the position of said lasers so that said first and second beams and lie in said first plane.

10. The apparatus of claim 9 wherein said first and second targets of said measuring units are disposed near the ends of said first and second lasers; and including a light delivery passage formed in said array of light sensing elements which allows delivery of said first and second beams through said first and second targets.

11. Earth boring apparatus of the type which includes a cutting head for cutting an underground bore through the earth, and steering system for steering the cutting head through the earth to form a bore in a prescribed direction, said apparatus comprising:

an operating platform disposed at a starting point;

a plurality of measuring units disposed successively along said bore in relational position to a desired direction of said bore, and carried at least by said cutting head and near said platform;

said measuring units including a first beam transmitted in a first direction and a second beam directed in a second, reversed direction;

a pair of targets carried at opposing ends of said measuring units including a first target disposed on one end and a second target disposed on an opposing end;

said first beam of a first measuring unit passing through a first target and impinging upon a second target of a second measuring unit disposed near said first measuring unit in said first direction;

said second beam of said first measuring unit passing through said second target, and impinging upon a first target of a third measuring unit disposed near said first measuring unit in said second direction;

said second target of said second measuring unit including a detector for providing coordinate position signals in response to the impingement of said first beam upon said detector representing a position defined by two coordinates; and said first target of said first measuring unit including a detector for providing an angle signal responsive to the impingement of said second beam upon said detector representing an angular relationship between said first and second measuring units.

12. The apparatus of claim 10 including a computer for receiving said coordinate and angle signals for determining the position of said cutting relative to said platform so that said cutting head may be steered to cut said bore along a desired underground path.

13. The apparatus of claim 11 including a home measuring unit disposed at said drilling platform which includes a first beam, and a front target.

14. The apparatus of claim 13 including an end measuring unit carried by said cutting head which includes only a target.

15. The apparatus of claim 11 wherein said detector of said first and second targets include a photo array of light sensing elements for detecting an area on said target upon which said first and second beams impinge.

16. The apparatus of claim 15 including a processing circuit for processing signals from said light sensing elements and generating said coordinate and angle signals for transmission to a computer for processing.

17. The apparatus of claim 11 wherein said first beam is transmitted in a forward direction, and said second beam is directed in a rearward direction; and wherein said first target is disposed on a front end of said measuring units and said second target is disposed on a back end of said measuring units.

18. The apparatus of claim 11 wherein said first and second beams coincide and lie in a first plane, and said targets comprise an array of light sensing elements disposed in a second plane orthogonal to said first plane of said first and second beams.

19. The apparatus of claim 18 wherein said measuring units include a first laser and a second laser mounted in a back-to-back relation; and an adjustable mount for adjusting the position of said lasers so that said first and second beams and lie in said first plane.

20. The apparatus of claim 19 wherein said first and second targets of said measuring units are disposed near the ends of said first and second lasers; and including a light delivery passage formed in said array of light sensing elements which allows delivery of said first and second beams through said first and second targets.

21. Apparatus for forming an underground bore of the type which uses a cutting head which is steered underground from an operating platform to form said bore in a prescribed direction and a measuring system for determining the position of said cutting head, wherein said measuring system comprises:

a measuring unit which includes first laser unit emitting a first beam in a first direction;

a second laser unit mounted in a back-to-back relation to said first laser unit, said second laser unit emitting a second beam directed in a second reversed direction; and a pair of targets carried at opposing ends of said measuring unit including a first target disposed on one end and a second target disposed on an opposing.

22. The apparatus of claim 21 wherein said first beam of said measuring units impinges upon a second target of an adjacent measuring unit disposed in said second direction.

23. The apparatus of claim 21 wherein said first and second targets include detectors for providing positional signals in response to the impingement of said first and second beams upon said detectors.

24. The apparatus of claim 23 wherein said first targets of said measuring units include a detector for providing an angle signal representing an angular relationship between said measuring units; and, said second targets include detectors which provide positional signals corresponding to a pair of position coordinates representing a coordinate position relationship between said measuring units.

25. The apparatus of claim 24 wherein said system comprises a computer for receiving said coordinate and angular signals for determining the position of said cutting head relative to said platform.

26. The apparatus of claim 21 including a home measuring unit disposed at said platform which includes a first beam, and a front target.

27. The apparatus of claim 26 including an end measuring unit carried by said cutting head which includes only a target.

28. The apparatus of claim 21 wherein said first and second targets include a photo array of light sensing elements for detecting an area on said target upon which said first and second beams impinge.

29. The apparatus of claim 28 including a processing circuit for processing signals from said light sensing elements and generating said coordinate and angle signals for transmission to a computer for processing.

30. The apparatus of claim 21 wherein said first beam is transmitted in a forward direction, and said second beam is directed in a rearward direction; and wherein said first target is disposed on a front end of said measuring units and said second target is disposed on a back end of said measuring units.

31. The apparatus of claim 30 wherein said first and second beams coincide and lie in a first plane, and said targets comprise an array of light sensing elements disposed in a second plane orthogonal to said first plane of said first and second beams.

32. The apparatus of claim 31 wherein said measuring units include a first laser and a second laser mounted in a back-to-back relation; and means for adjusting the position of said lasers so that said first and second beams and lie in said first plane.

33. The apparatus of claim 32 wherein said first and second targets of said measuring units are disposed near the ends of said first and second lasers; and including a light delivery passage formed in said array of light sensing elements which allows delivery of said first and second beams through said first and second targets.

* * * * *